US007924130B2

(12) United States Patent
Buckmeier et al.

(10) Patent No.: US 7,924,130 B2
(45) Date of Patent: Apr. 12, 2011

(54) ISOLATION MAGNETIC DEVICES CAPABLE OF HANDLING HIGH SPEED COMMUNICATIONS

(75) Inventors: Brian J. Buckmeier, San Diego, CA (US); John Hess, Timonium, MD (US); Joseph Berry, San Diego, CA (US); Edwin Edralin, San Diego, CA (US)

(73) Assignee: Bel Fuse (Macao Commercial Offshore) Limited

( * ) Notice: Subject to any disclaimer, the term of this patent is extended or adjusted under 35 U.S.C. 154(b) by 0 days.

(21) Appl. No.: 12/194,645

(22) Filed: Aug. 20, 2008

(65) Prior Publication Data

US 2010/0045420 A1 Feb. 25, 2010

(51) Int. Cl.

| | |
|---|---|
| ***H01F 27/28*** | (2006.01) |
| ***H01F 27/00*** | (2006.01) |
| ***H01F 21/06*** | (2006.01) |
| ***H01F 17/04*** | (2006.01) |
| ***H01F 7/06*** | (2006.01) |

(52) U.S. Cl. ..... 336/180; 336/90; 336/131; 336/221; 336/222; 336/170; 29/605

(58) Field of Classification Search ..... None
See application file for complete search history.

(56) References Cited

U.S. PATENT DOCUMENTS

| | | | | |
|---|---|---|---|---|
| 3,290,635 | A * | 12/1966 | Hofmann et al. | 336/100 |
| 5,179,732 | A * | 1/1993 | Omoto | 455/330 |
| 5,705,961 | A * | 1/1998 | Yee | 333/131 |
| 5,929,738 | A * | 7/1999 | Orlando | 336/180 |
| 6,739,915 | B1 * | 5/2004 | Hyland et al. | 439/676 |
| 6,963,256 | B2 * | 11/2005 | Setty et al. | 333/131 |
| 2002/0048159 | A1 * | 4/2002 | Tsao et al. | 361/807 |
| 2006/0114094 | A1 * | 6/2006 | Jean et al. | 336/182 |

FOREIGN PATENT DOCUMENTS

JP 362239505 A * 10/1987

* cited by examiner

*Primary Examiner* — Elvin G Enad
*Assistant Examiner* — Mangtin Lian
(74) *Attorney, Agent, or Firm* — Cozen O'Connor

(57) ABSTRACT

An isolation magnetic device produced by inserting a first end of a wire through a first hole of a core, wrapping the first end of the wire around a first side of the core and inserting the first end of the wire through a second hole of the core. The second hole of the core is spaced from the first hole and has a longitudinal axis extending parallel to a longitudinal axis of the first hole. The device is further produced by inserting a second end of the wire through the second hole of the core, wrapping the second end of the wire around the first side of the core and inserting the second end of the wire through the first hole of the core.

10 Claims, 14 Drawing Sheets

ISOLATION MAGNETIC DEVICES CAPABLE OF HANDLING HIGH SPEED COMMUNICATIONS

BACKGROUND OF THE INVENTION

Regulations for connector technology are evolving. As signal speeds increase and the connector industry desires to move data faster over cables, there is a need for isolating magnetic devices capable of handling higher magnetizing forces and DC current bias. In a typical RJ45 type connector assembly where a modular plug mates in a male-female relationship with a modular jack, an isolating magnetic device is used in the female connector portion to handle direct current ("DC") offsets. Such offsets may be caused by various factors including imbalances in the wires of the plug.

For example, data is frequently transmitted over a pair of conductive wires. When transmitting data, the pair of wires may ideally have voltage potentials to ground such that a voltage in one wire of the pair is equal and opposite to the voltage in the other wire of the pair. For example, one wire may have a potential of −2.5 volts and the other wire may have a potential of +2.5 volts. If there are imbalances in the pair of wires or extraneous electromagnetic interference, the two wires may not have exactly equal and opposite voltages. For example, one wire may have −2 volts and the other wire may have +3 volts. Although there is still a net difference across the pair of wires of +5 volts (which may, for example, correspond to a logic "1"), such a voltage imbalance will generate a current imbalance. Conventional technology uses isolating magnetic devices and/or transformers to deal with such imbalances. However, prior art magnetic devices cannot physically handle the magnetizing force which may be induced by imbalanced current having high frequencies.

As an illustrative example, referring to FIG. 1, there is shown a transformer 40 in accordance with the prior art. Transformer 40 may be used as an isolating magnetic device. Transformer 40 is formed by winding wires 44, 46, 48 and 50 around a toroid shaped core 42. Core 42 has a substantially circular cross-section. Wires 44, 46, 48 and 50 are evenly wound around core 42 except in a gap area 38.

Such prior art solutions like transformer 40 can handle data communications perhaps as high as 2 million bits per second. However, newer standards require that communications occur as high as one (1) or even ten (10) gigabits per second. The above prior art isolation magnetic device generally does not have the frequency response characteristic needed to inhibit the presence of DC current bias with communications of such speeds. Even for solutions which are capable of handling high speed (e.g. 2M bits per second) communications, they typically are not backward compatible (i.e. they cannot handle slower communications) and are frequently not in a conventional RJ45 type connector format. Such a format is common in the industry and most users have become comfortable with it.

SUMMARY OF THE INVENTION

One aspect of the invention is a method for producing an isolation magnetic device. The method comprises inserting a first end of a wire through a first hole of a core, wrapping the first end of the wire around a first side of the core and inserting the first end of the wire through a second hole of the core. The second hole of the core is spaced from the first hole and has a longitudinal axis extending parallel to a longitudinal axis of the first hole. The method further comprises inserting a second end of the wire through the second hole of the core, wrapping the second end of the wire around the first side of the core and inserting the second end of the wire through the first hole of the core.

Another embodiment of the invention is an isolation magnetic device comprising a core including a first hole and a second hole. The second hole of the core is spaced from the first hole and has a longitudinal axis extending parallel to a longitudinal axis of the first hole. The device further comprises a wire having first and second ends, the first end of the wire extending through the first hole of a core, around a first side of the core and through a second hole of the core in first direction the second end of the wire extending through the second hole of the core, around the first side of the core and through the first hole of the core in a second direction.

BRIEF DESCRIPTION OF THE DRAWINGS

A more complete appreciation of the present invention and many of the attendant advantages thereof will be readily understood by reference to the following detailed description when taken in conjunction with the accompanying drawings in which.

DETAILED DESCRIPTION OF THE PREFERRED EMBODIMENT(S)

Figure 1:
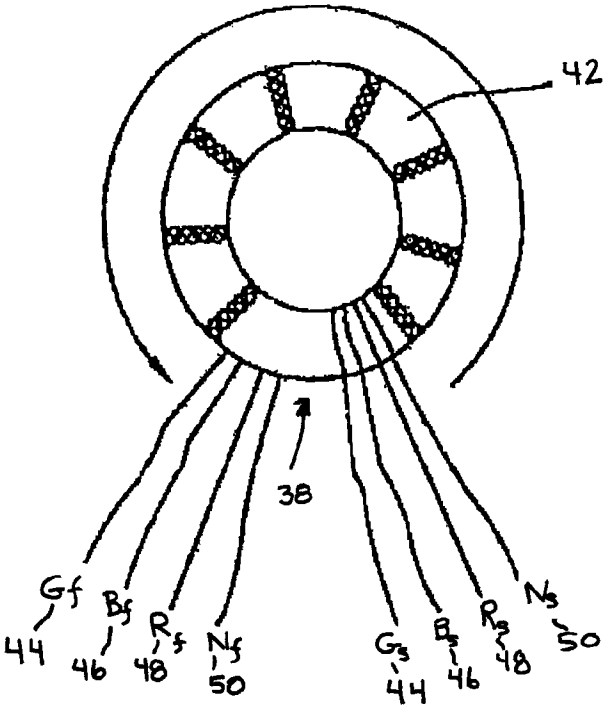
Fig. 1 Prior Art
FIG. 1 is a front view of a transformer in accordance with the prior art.
Figure 2:
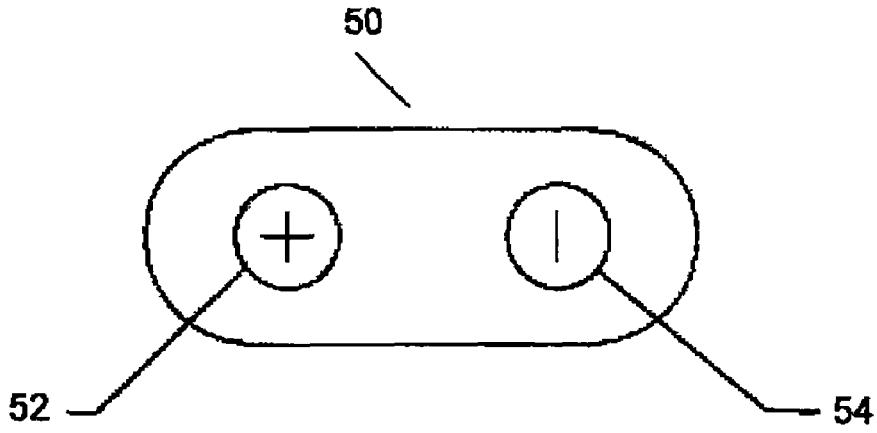
FIG. 2 is a top view of a core which may be used in accordance with an embodiment of the invention.
Figure 2A:
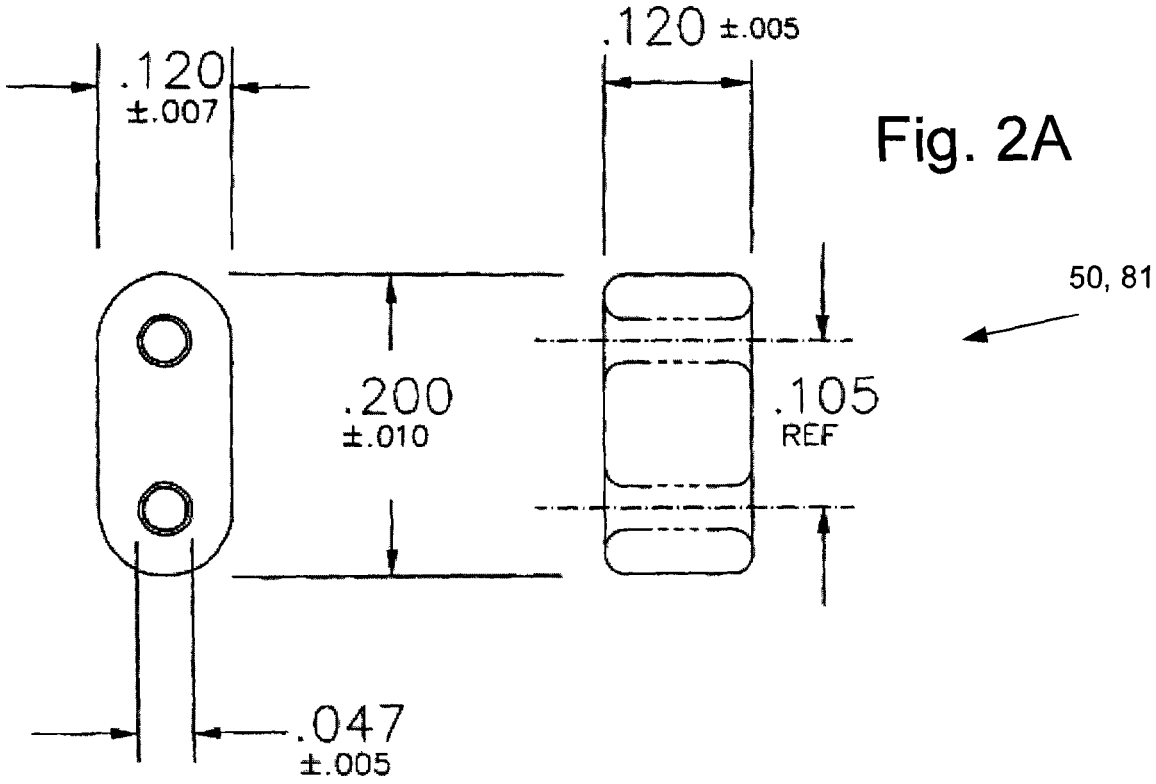
FIGS. 2A and 2B are top views of cores which may be used in accordance with an embodiment of the invention.
Figure 2B:
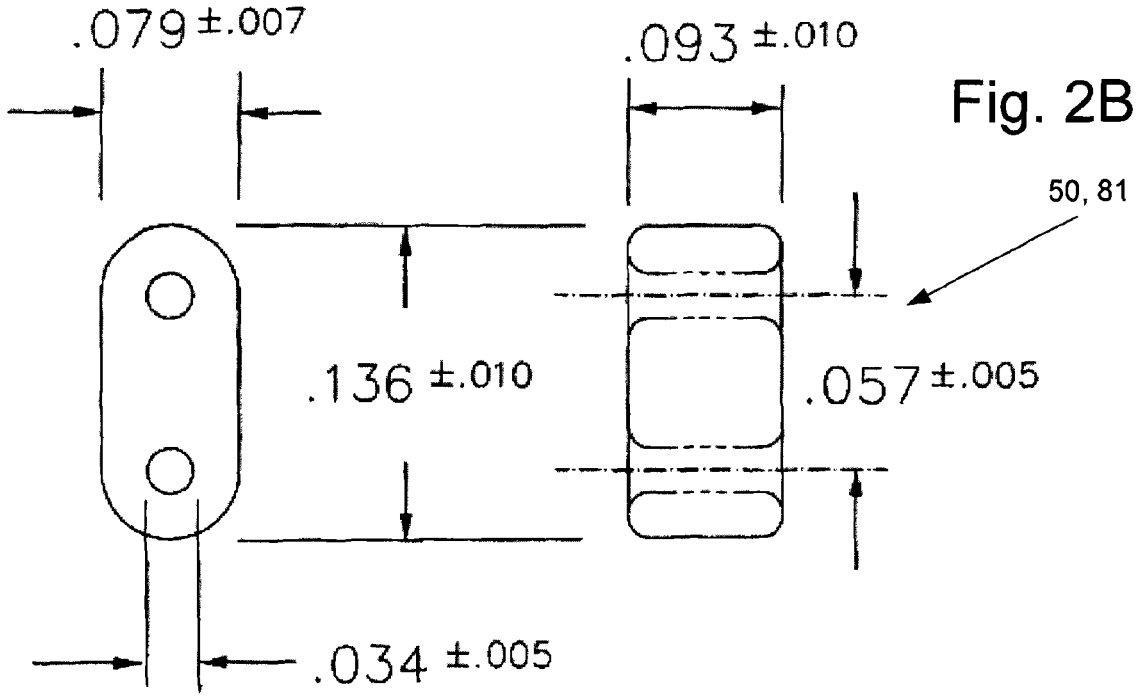

Referring now to the drawings wherein like reference numerals describe identical or corresponding parts throughout the several views, and more particularly to FIG. 2, a core 50 is shaped substantially like an ellipsoid with its ends cut off and has a substantially racetrack-shaped cross-section. Core 50 includes a first hole 52 and a second hole 54. Core 50 may have, for example, a material permeability of between 1500 and 5000 and size dimensions as shown in FIG. 2A or 2B. For example, for the size dimensions shown in FIG. 2A, core 50 may be made with chamfered tooling and tumbled to remove sharp edges. Under a first test condition, at 100 KHz, B=5 G, u(Ref.)=5000, AL=5638.7 nH /$N^2$±30% with a loss factor of <=$15\times10^{-6}$. The core may be coated overall with Parylene C to 0.0005"-0.0010". Dimensions may beprior to the coat and the core may be ROHS compliant. For the size dimensions shown in FIG. 2B, core 50 may be manufactured with flat faced tooling with a pre-sintered edge rounding process. Under a first test condition, at 100 KHz, B=5 G, AL=1110 nH /$N^2$±25%, ui=1500(Ref) with a loss factor of <=$60\times10^{-6}$. Under a second test condition, at 100 MHz, 1 turn #24, Z=41.74 ohms±25%. The core may be coated 12-315-G overall with Parylene C 0.0005" min to 0.0010" max thickness. Dimensions may be prior to the coat and the core may be ROHS compliant.

Figure 3:
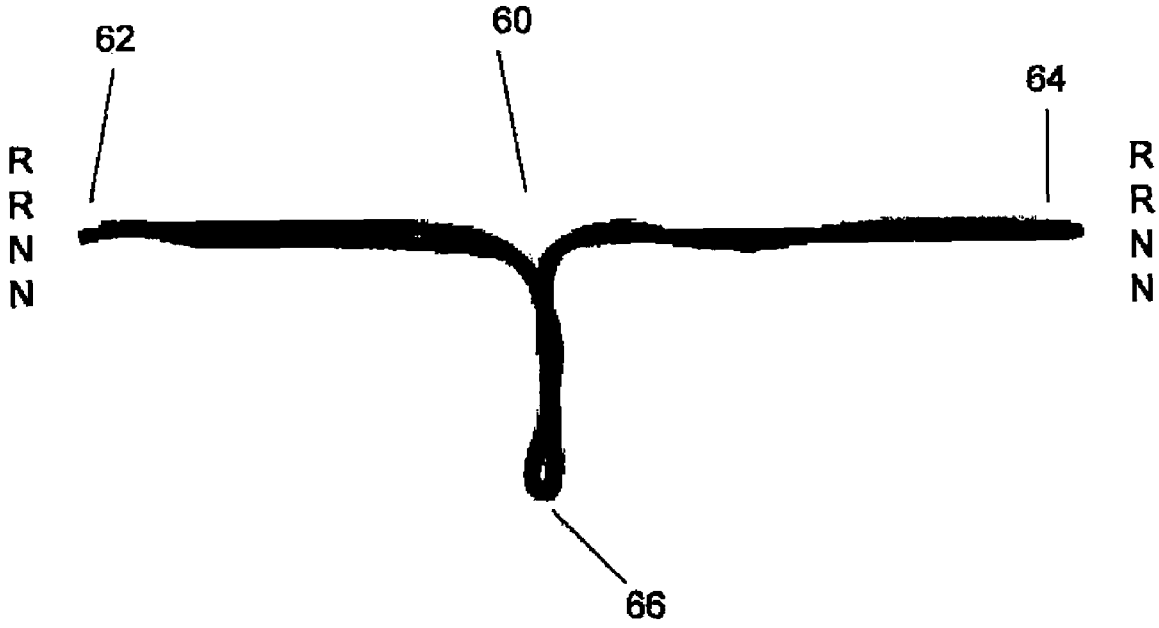
FIG. 3 is a side view of a set of wires which may be used to produce an isolation magnetic device in accordance with an embodiment of the invention.

Core 50 is used to produce an isolation magnetic device in accordance with an embodiment of the invention. Referring also to FIG. 3, to produce the isolation magnetic device, wires 60 are wound around core 50 in a particular matter. The windings may be performed such that subsequent windings are placed adjacent to prior windings. Two red and two natural color #40 QPN 180 wires 60 may be used. Clearly, the choice of color is arbitrary and has no bearing on the invention. Similarly, any size wire may be used. However the use of only two sets wires is beneficial in that they result in lower inner winding capacitance and a better return loss (power of a wave reflected because of imperfections in the communications link) measurement. Each pair of similarly colored wires may be twisted 12 twists per inch.

A center of wires 60 is bunched out to form a tap 66 that may later be used as a drain for high frequency noise in a produced isolation magnetic device. Shown in FIG. 3 are first end 62 of wires 60 including two red ("R") wires and two natural ("N") wires and a second end 64 of wires 60 including two red and two natural wires.

Figure 4:
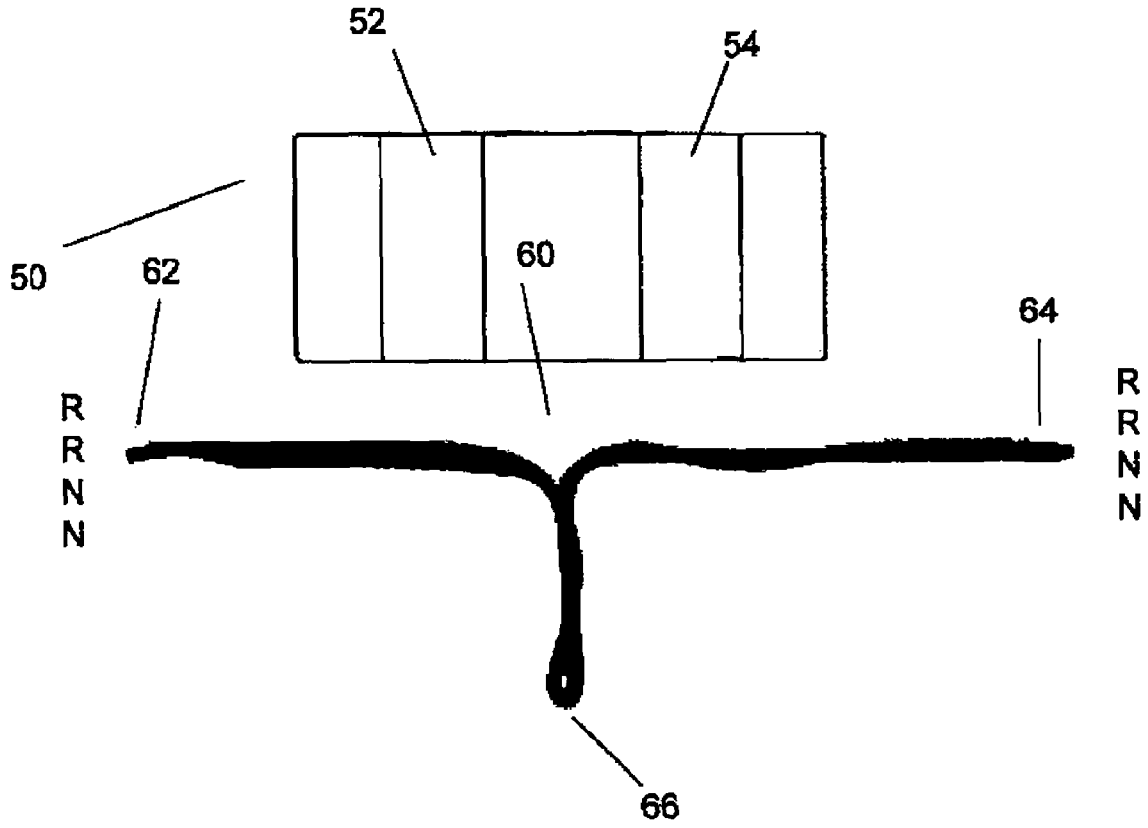
FIG. 4 is a side view of a set of wires and a core which may be used to produce an isolation magnetic device in accordance with an embodiment of the invention.
Figure 5:
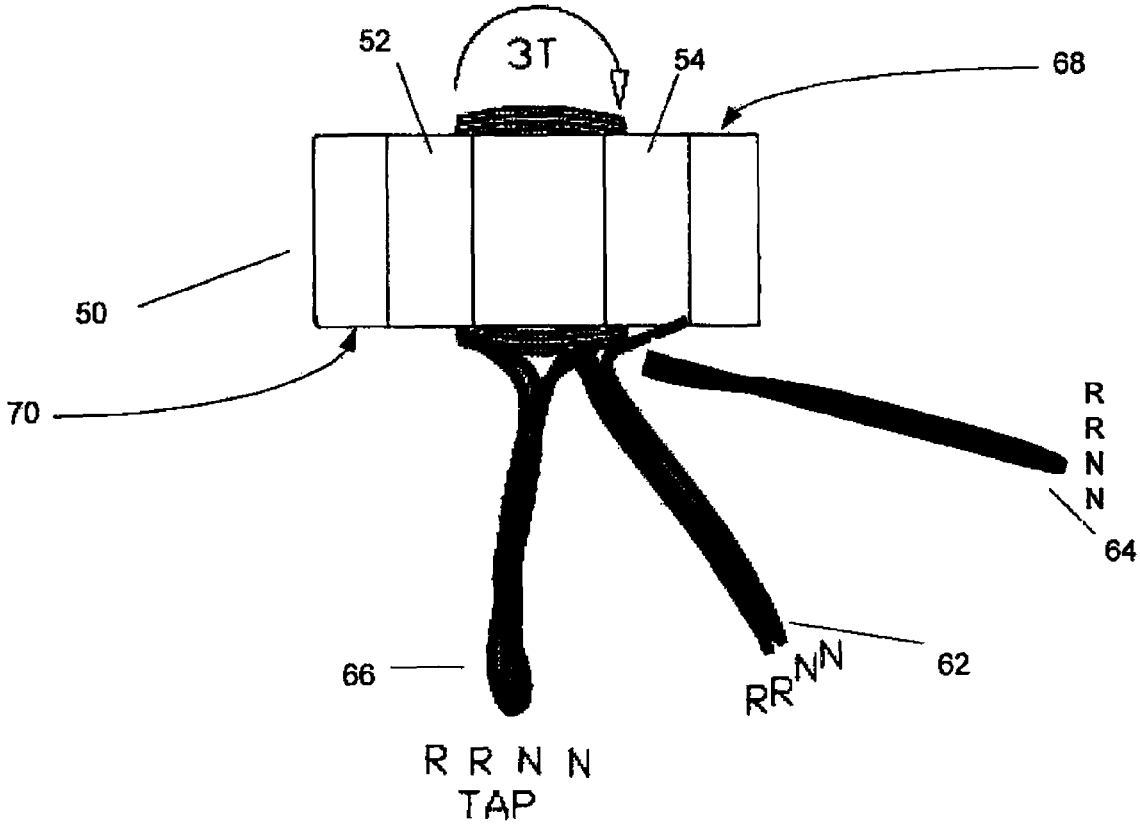
FIG. 5 is a side view of a partially produced isolation magnetic device in accordance with an embodiment of the invention.

A method for producing an isolation magnetic device will now be explained. Wires 60 are placed proximate to core 50 as shown in FIG. 4 so that tap 66 is disposed proximate to a center of core 50. Thereafter, as shown in FIG. 5 first end 62 of wires 60 are inserted through hole 52, wrapped around a side 68 of core 50 and inserted through hole 54. First end 62 of wires 60 are then wrapped around a second side 70 of core 50 and then inserted through hole 52, wrapped around side 68 and then inserted through hole 54. The wrapping and insertions are continued for a total of three insertions through hole 54. During these windings of first end 62 of wires 60, second end 64 of wires 60 remain untouched. It should be clear, however, that windings of second end 64 of wires 60 (discussed below) could take place at the same time as, or sequentially with, windings of first end 62 of wires 60. The windings preferably are made as tight as possible without cracking the insulation of wires 60 preferably with less than 0.005 inches of air between wires 60 and core 50. FIG. 5 shows the result of the three insertions of first end 62 of wires 60 through hole 54. As shown in the figure, first end 62 of wires 60 extend through hole 52, around first side 68, through hole 54 and around second side 70. First end 62 of wires 60 are wound around core 50 in a first direction—in the figure that direction is clockwise.

Figure 6:
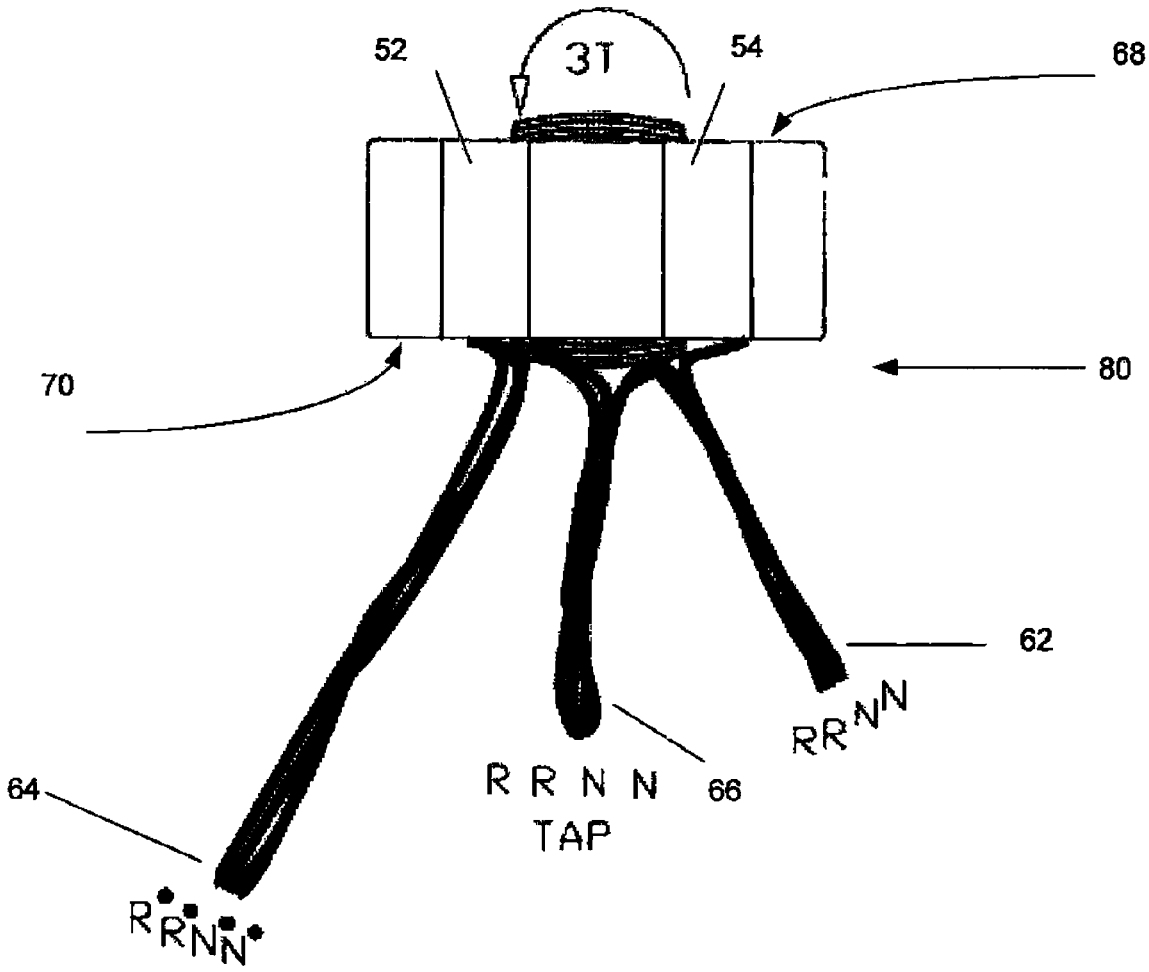
FIG. 6 is a side view of an isolation magnetic device produced in accordance with an embodiment of the invention.

Similarly, as shown in FIG. 6, to produce the isolation magnetic device, second end 64 of wires 60 are inserted through hole 54, wrapped around side 68 of core 50 and inserted through hole 52. Second end 64 of wires 60 are then wrapped around second side 70 of core 50 and then inserted through hole 54, wrapped around side 68 and then inserted through hole 52. The wrapping and insertions are continued for a total of three insertions through hole 52. Clearly, second end 64 of wires 60 may also be inserted on another side of core 50 so that the wrappings around first side 68 and second side 70 are switched. During these windings of second end 64 of wires 60, first end 62 of wires 60 remain untouched. It should be clear, however, that windings of first end 62 of wires 60 could take place at the same time as, or sequentially with, windings of second end 64 of wires 60. The windings preferably are made as tight as possible without cracking the insulation of wires 60. FIG. 6 shows the result of the three insertions of second end 64 of wires 60 through hole 52. As shown in the figure, second end 64 of wires 60 extend through hole 54, around first side 68, through hole 52 and around second side 70. Second end 64 of wires 60 are wound around core 50 in a second direction—in the figure that direction is counter-clockwise.

Second end 64 of wires 60 may be dressed longer then first end 62 of wires 60 and second end 64 of wires 60 may be assigned a dot notation so as to designate a primary winding of the resultant isolation magnetic device 80. After the windings, an additional two twists are made to all four (two red and two natural) wires in the first end 62 and in the second end 64 of wires 60.

FIG. 6 shows a transformer 80 produced by the above windings and can be used as an isolation magnetic element. Transformer 80 may then be dipped in 1C55 liquid silicon and then heated quickly so as to cure and protect wires 60 and transformer 80 from potential vibration damage.

Figure 7:
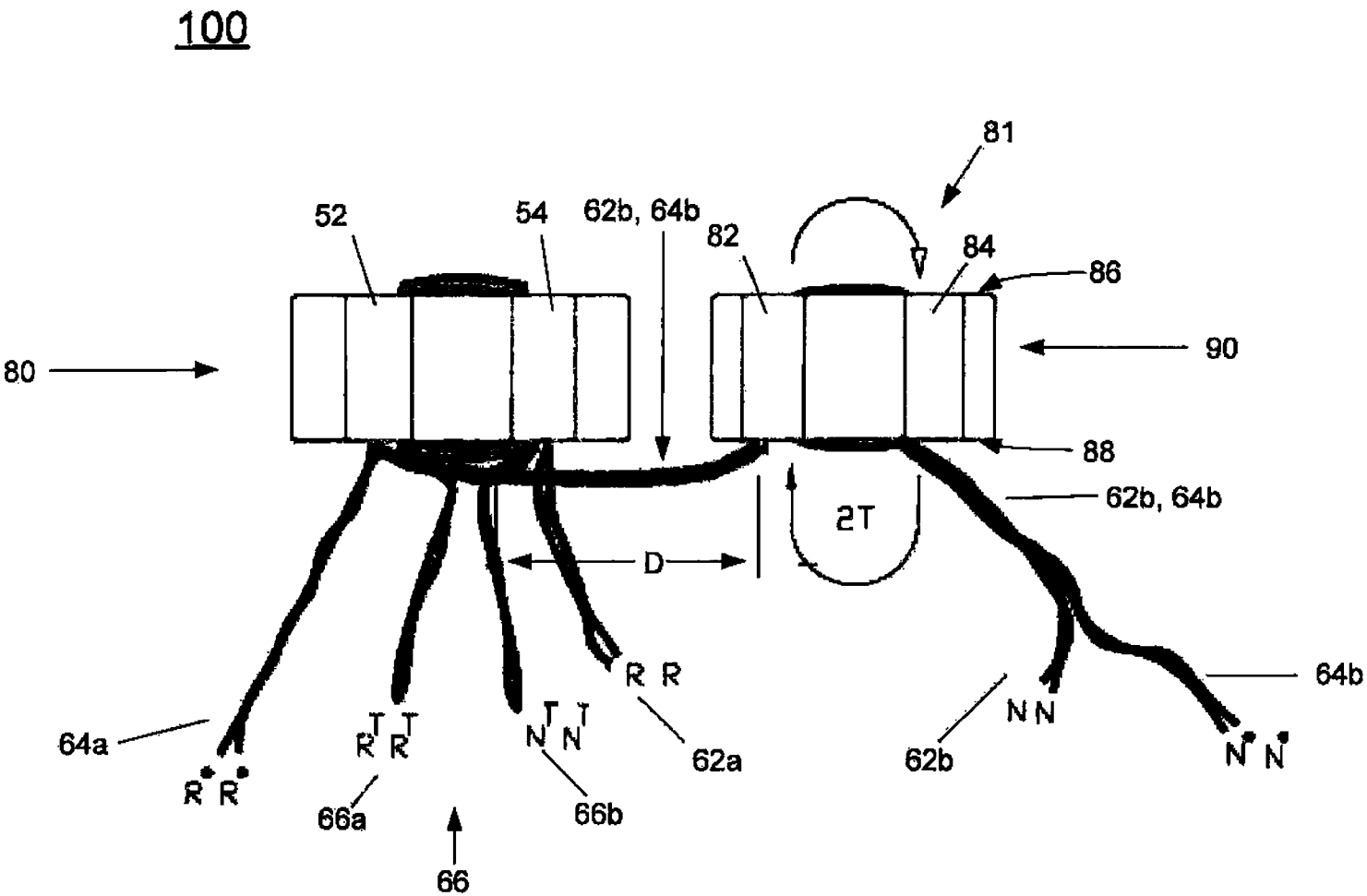
FIG. 7 is a side view of an isolation magnetic device comprised of two isolation magnetic devices produced in accordance with an embodiment of the invention.
Figure 8:
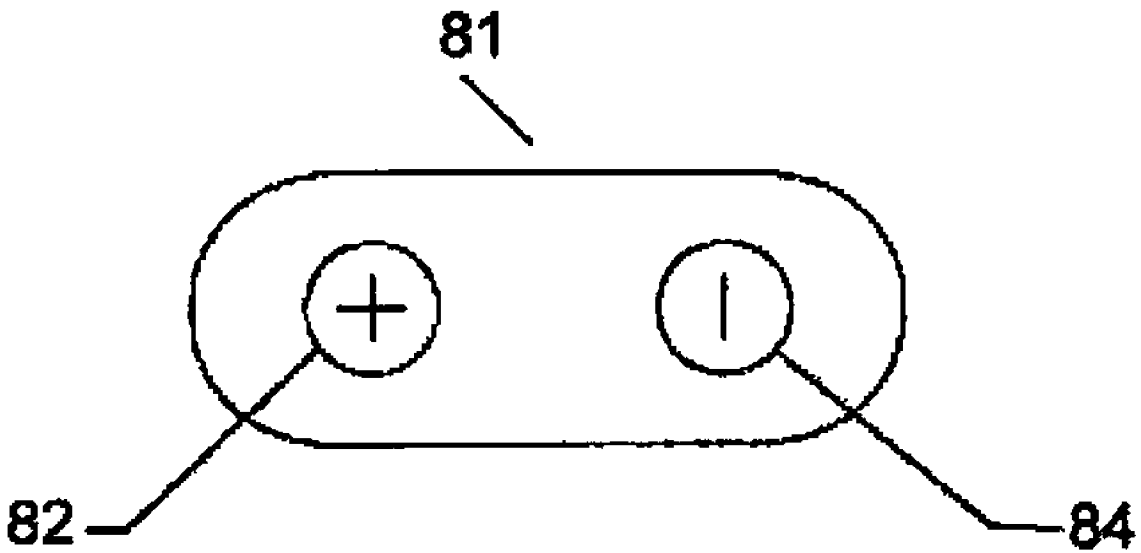
FIG. 8 is a top view of a core which may be used in accordance with an embodiment of the invention.

Referring now to FIG. 7, after transformer 80 is dipped in silicon and cured, first end 62, second end 64 and tap 66 are all split apart. Tap 66 is cut and split into a first tap 66*a* and a second tap 66*b* allowing multiple access points to tap 66. Second end 64 of wires 60 are split into red wires 64*a* and natural wires 64*b*. Similarly, first end 62 of wires 60 are split into red wires 62*a* and natural wires 62*b*. Natural wires 62*b*, 64*b* of the first and second end are twisted together and then fed to a second core 81. It is desirable that a distance D between second core 81 and transformer 80 be less than or equal to 0.1 inches so as to avoid parasitic capacitive coupling. As shown in FIG. 8, second core 81, like core 50, is shaped substantially like an ellipsoid with its ends cut off and has a substantially racetrack-shaped cross-section. Core 81 includes a first hole 82 and a second hole 84. Core 81 may have, for example, a material permeability of between 1500 and 5000 and size dimensions as shown in FIG. 2A or 2B.

Natural wires 62*b*, 64*b*, are inserted through hole 82, wrapped around a side 86 of core 81 and inserted through hole 84. Natural wires 62*b*, 64*b* are then wrapped around a second side 88 of core 81 and then inserted through hole 82, wrapped around side 86 and then inserted through hole 84 for a total of two insertions through hole 84 thereby forming a common mode choke 90. The two insertions through hole 84 result in less winding capacitance than some prior art techniques with more windings. After the two insertions through hole 84, natural wires 62*b*, 64*b* are twisted together until natural wires 62*b*, 64*b* are terminated at a termination. Similarly, red wires 62*a*, 64*a* and left tap and right tap 66*a*, 66*b* are twisted until terminated at a termination. The result is an isolation magnetic device 100 comprising isolation magnetic devices 80 (transformer) and 90 (common mode choke).

The dipping and curing of transformer 80 and wires 60 before splitting the wires apart and inserting them in core 81 helps ensure that the additional two twists of wires 60 are maintained. Common mode choke 90 is added after the curing. Unlike some prior art techniques, the common mode choke is not dipped in silicon as the inventors have determined that dipping the common mode choke into the silicon causes the silicon to go into holes 82, 84 and affects the return loss and capacitance of the common mode choke 90.

Figure 9C:
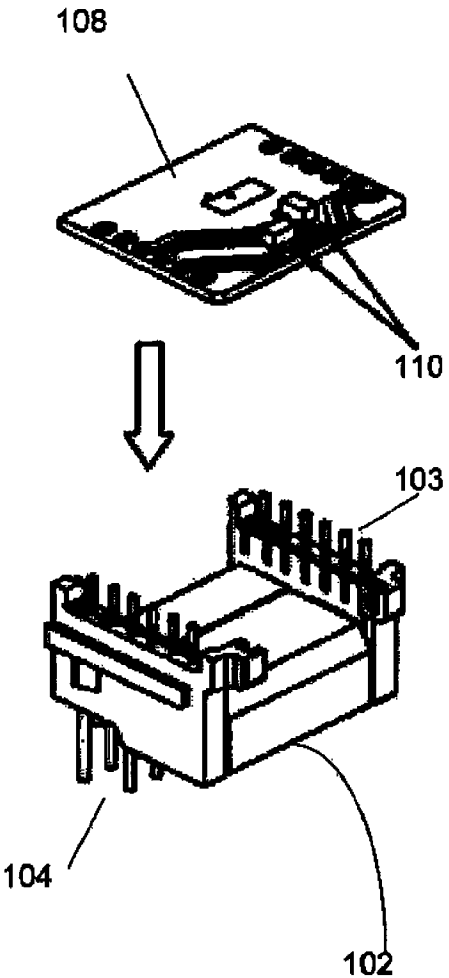
FIGS. 9B-9C are front perspective views showing the production of a connector including a plurality of isolation magnetic devices in accordance with an embodiment of the invention.
Figure 9B:
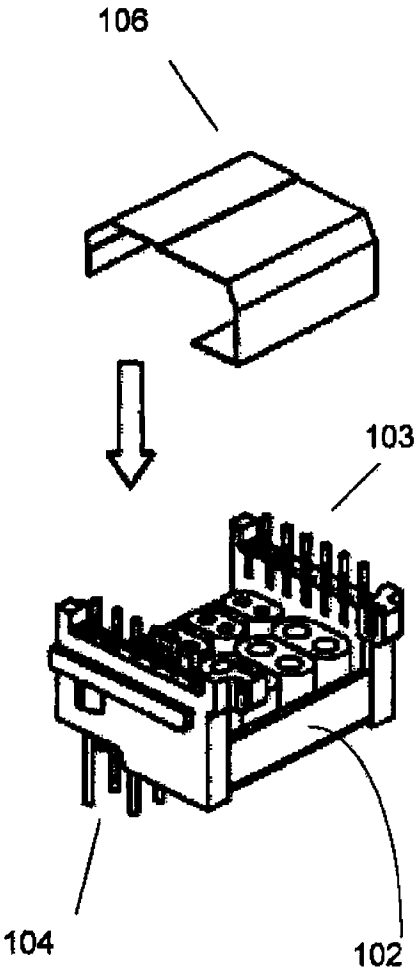
Figure 9A:
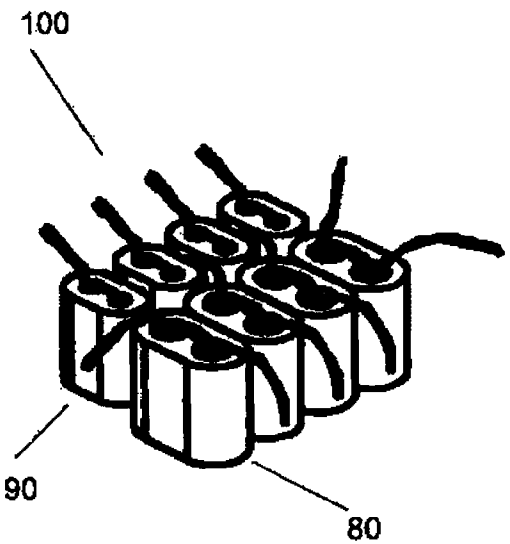
FIG. 9A is a front perspective view of isolation magnetic device in accordance with an embodiment of the invention.
Figure 11B:
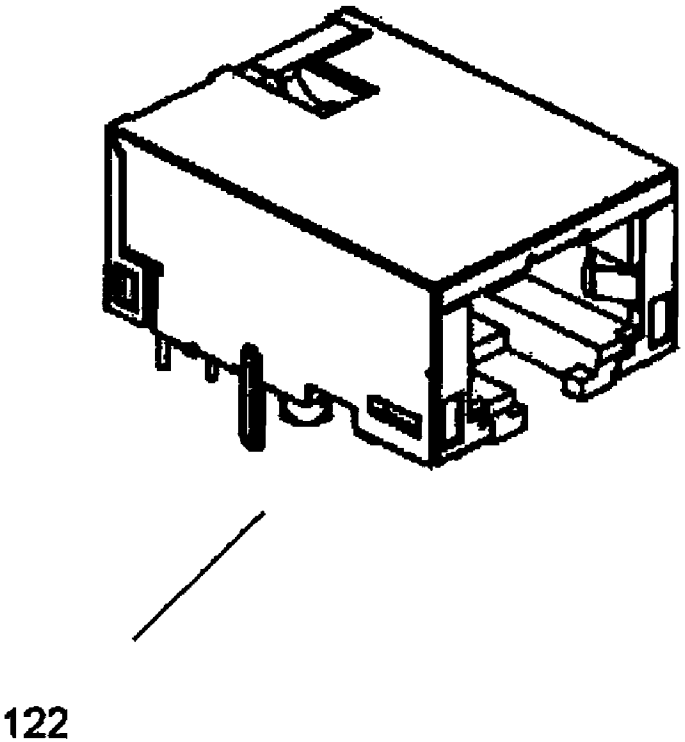
FIGS. 11A-11B are front perspective views showing the production of a connector including a plurality of isolation magnetic devices in accordance with an embodiment of the invention.
Figure 11A:
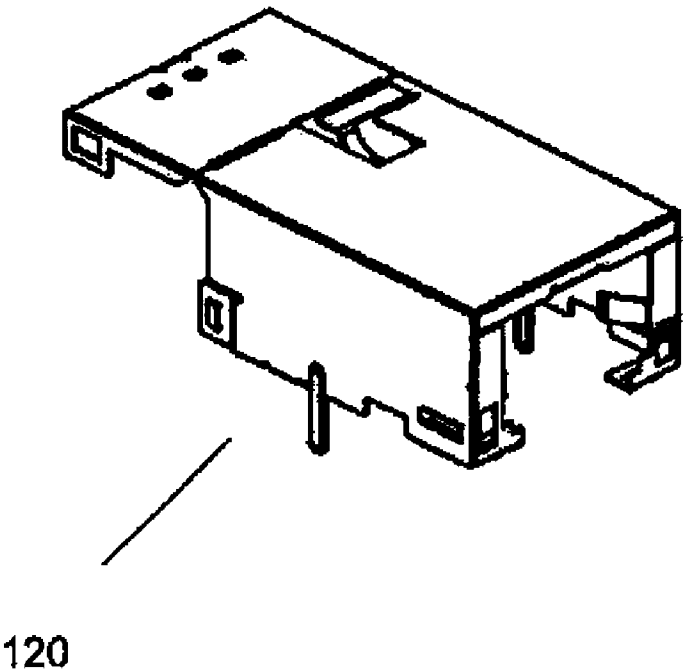
Figure 12:
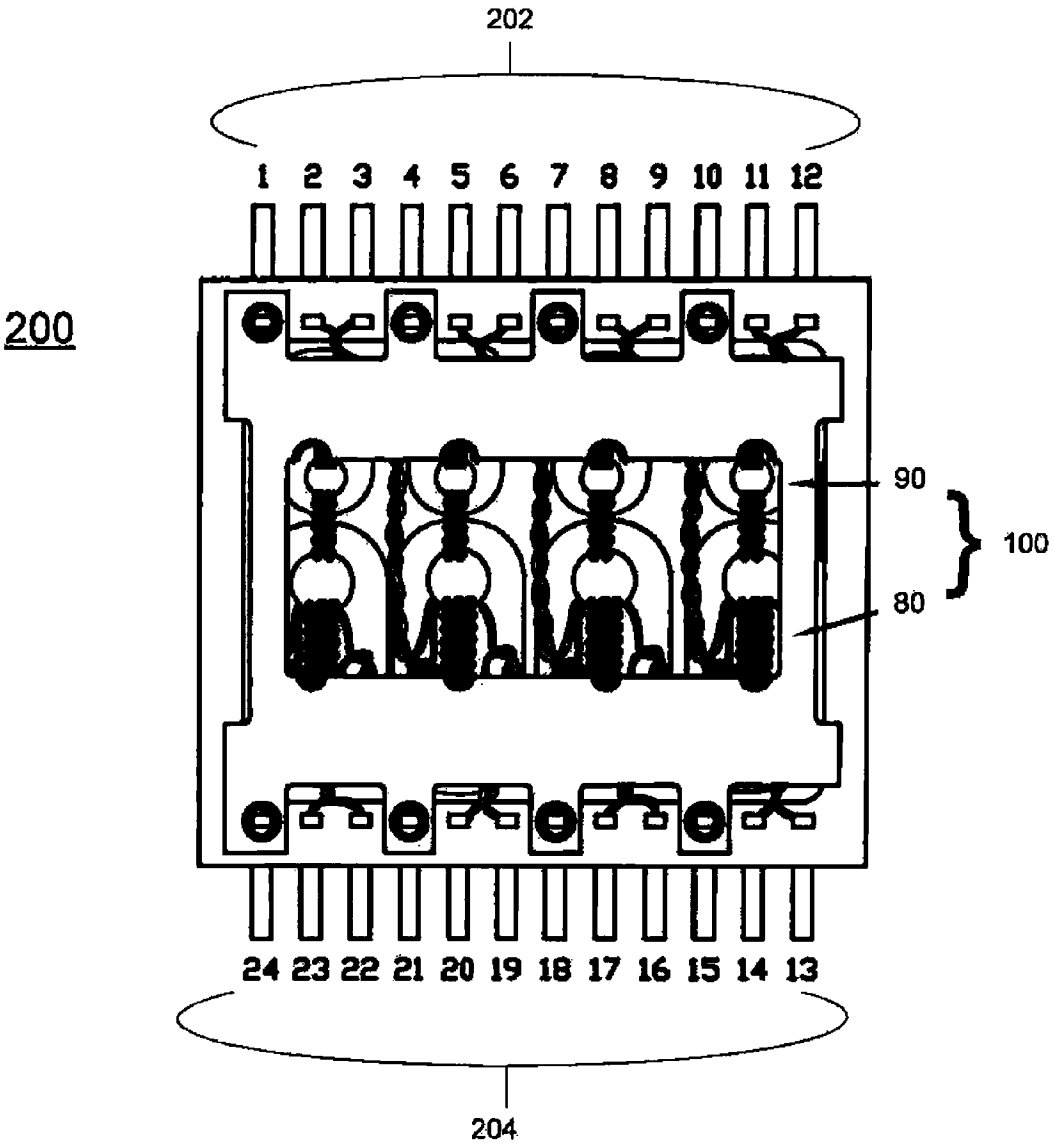
FIG. 12 is a top view of a discrete component including a plurality of isolation magnetic devices in accordance with an embodiment of the invention.
Figure 13:
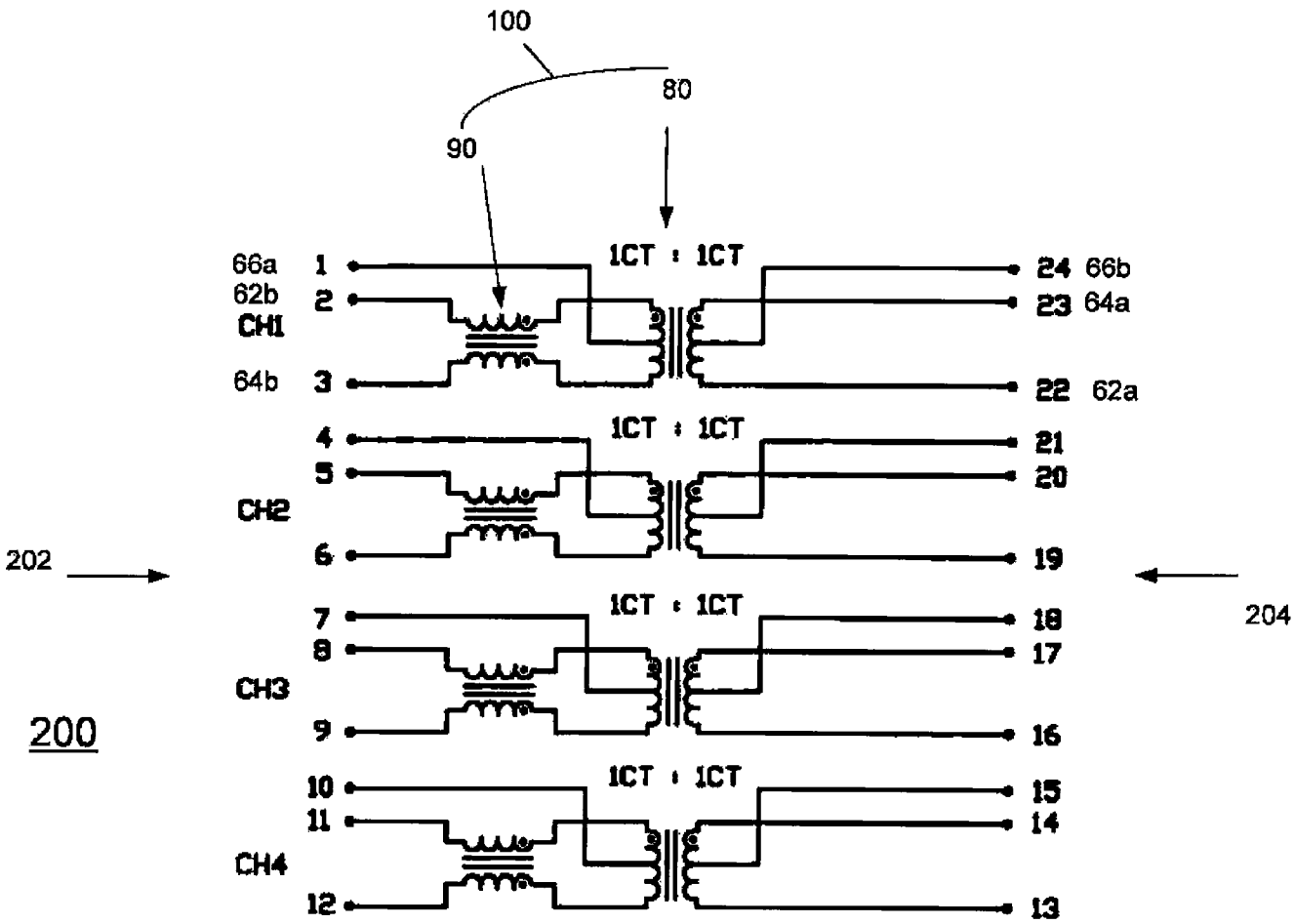
FIG. 13 is a circuit diagram illustrating a circuit layout including isolation magnetic devices that could be used in accordance with an embodiment of the invention.

A plurality of isolation magnetic devices 100 may be combined and used together as shown in FIG. 9A. For example, four isolation magnetic devices 100 may be used for four communication channels (eight wires). Isolation magnetic devices 100 may be used alone as discrete devices, or in a connector. FIGS. 9B-11 show an example of how a connector may be made using isolation magnetic devices 100. FIGS. 12-13 show how isolation magnetic devices 100 may be used in a discrete component.

As shown in FIG. 9B, in forming a connector, isolation magnetic devices 100 are placed in a bucket 102. Bucket 102 has terminals 104 extending downwardly therefrom so as to enable electrical connection between the connector and a circuit board. Bucket 102 similarly has contacts 103 extending upwardly that will be put in electrical communication with contacts of the connector. A piece of tape 106 is placed over isolation magnetic elements 100.

As shown in FIG. 9C, a printed circuit board 108 is placed on bucket 102 so that traces on the printed circuit board 108 communicate with contacts 103. Printed circuit board 108 may have capacitors 110 disposed between connector contacts generally referred to as contacts 3 and 6 (channel 2) and between connector contacts generally referred to as contacts 4 and 5 (channel 3). Capacitors 110 may have a value of 1.5 pF and help prevent crosstalk between channels 2 and 3.

Figure 10C:
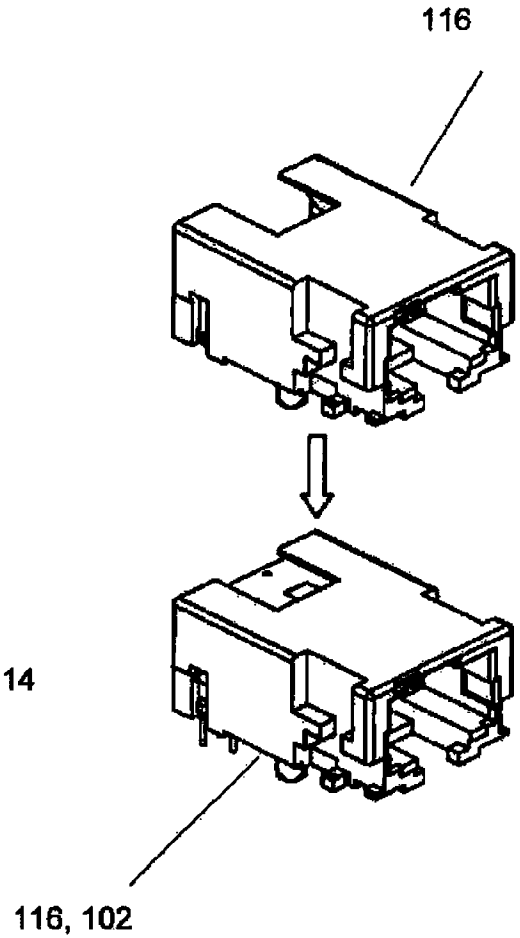
FIGS. 10A-10C are front perspective views showing the production of a connector including a plurality of isolation magnetic devices in accordance with an embodiment of the invention.
Figure 10B:
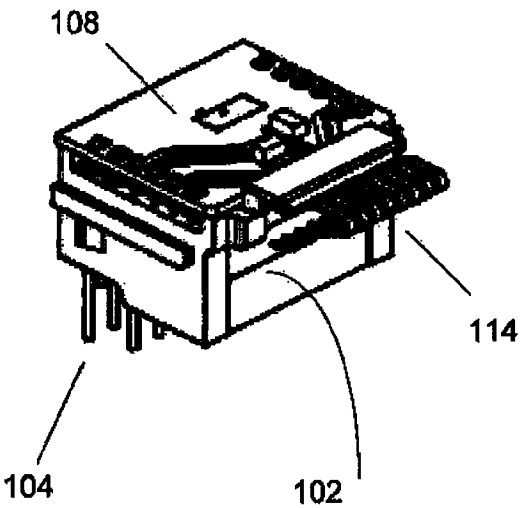
Figure 10A:
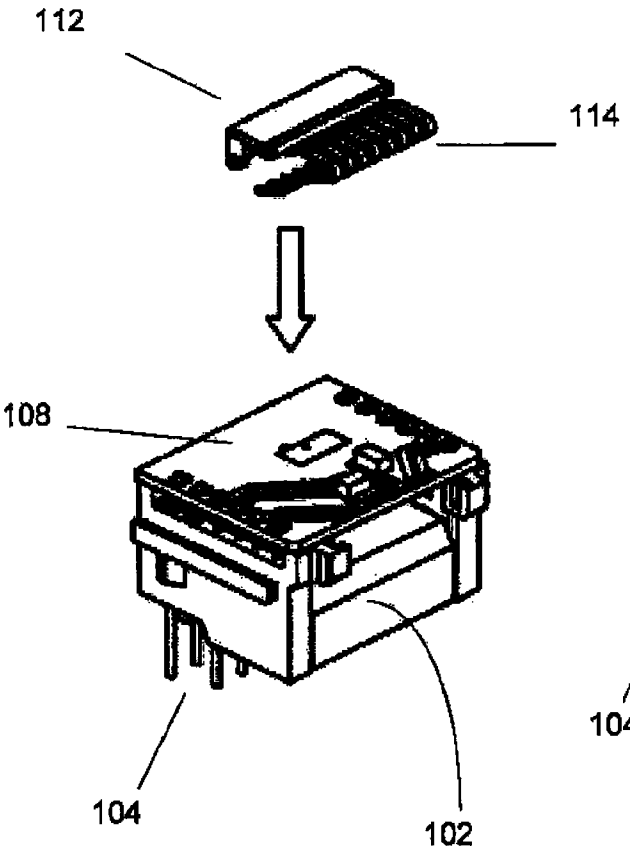

Referring to FIGS. 10A and 10B, a contact board 112 with contacts 114 is connected to bucket 102 so that contacts 114 communicate with traces on printed circuit board 108. As shown in FIG. 10C, a housing 116 may be placed over bucket 102. As shown in FIG. 11A a metal shield 120 may be placed over bucket 102 and the result is a connector 122 shown in FIG. 11B.

Referring to FIG. 12, four sets of isolation magnetic elements 100 may also be used for four respective channels in a discrete component 200. Ends of transformer 80 and common mode choke 90 may be connected to terminals 202, and 204 respectively. Shown in FIG. 13 is a circuit diagram illustrating the circuit layout for discrete component 200 and the respective connections of terminals 202, 204. Also shown in FIG. 13, are the repective wire terminations for channel 1 as was described with reference to isolation magnetic device 100 shown in FIG. 7.

The invention has been described with reference to an embodiment that illustrates the principles of the invention and is not meant to limit the scope of the invention. Modifications and alterations may occur to others upon reading and understanding the preceding detailed description. It is intended that the scope of the invention be construed as including all modifications and alterations that may occur to others upon reading and understanding the preceding detailed description insofar as they come within the scope of the following claims or equivalents thereof. Various changes may be made without departing from the spirit and scope of the invention. Preferred embodiments of the invention have been shown, the invention is only limited as defined by the scope of the accompanying claims.

What is claimed is:

1. An isolation magnetic device comprising:

a core including a first hole and a second hole, the second hole of the core being spaced from the first hole and having a longitudinal axis extending parallel to a longitudinal axis of the first hole; and a wire having first and second ends, the first end of the wire extending through the first hole of a core, around a first side of the core and through a second hole of the core in first direction;

the second end of the wire extending through the second hole of the core, around the first side of the core and through the first hole of the core in a second direction and wherein a portion of the wire between the first end and the second end is bunched to produce a tap for said isolation magnetic device; and wherein the wire comprises a first and a second wire; and wherein the core is a first core, and the device further comprises;

a second core including a first hole and a second hole, the second hole of the second core being spaced from the first hole and having a longitudinal axis extending parallel to a longitudinal axis of the first hole;

the first and second ends of the first wire twisted to produce a twisted wire;

the twisted wire extending through the first hole of the second core, around a first side of the second core, and through the second hole of the second core.

2. The device as recited in claim 1, further comprising silicon disposed in the core and around the first and second wires.

3. The device as recited in claim 1, further comprising:

the twisted wire wrapped around a second side of the second core, extending through the first hole of the second core, wrapped around the first side of the second core and extending through the second hole of the second core.

4. The device as recite in claim 1, wherein the tap is split to produce a first and second tap.

5. The device as recited in claim 1, further comprising the twisted wire wrapped around a second side of the second core, extending through the first hole of the second core, wrapped around the first side of the second core and extending through the second hole of the second core.

6. The device as recited in claim 1, wherein a distance between the first and second cores is equal to or less than 0.1 inches.

7. The device as recited in claim 3, further comprising:

a bucket effective to hold the first and second core, the bucket including terminals;

a circuit board over the bucket, the circuit board including traces;

contacts in communication with the traces; wherein the twisted wire and the first and second ends of the second wire are in communication with at least one of the terminals and the contacts.

8. The device as recited in claim 3, further comprising the twisted wire and the first and second ends of the second wire being in communication with at least first and second sets of terminals.

9. An electronic device comprising:

A first core including a first hole and second hole, the second hole of the first core being spaced from the first hole and having a longitudinal axis extending parallel to a longitudinal axis of the first hole;

a second core including a first hole and a second hole, the second hole of the second core being spaced from the first hole of the second core and having a longitudinal axis extending parallel to a longitudinal axis of the first hole of the second core;

a first pair of twisted wires;

a second pair of twisted wires;

first ends of said first and second twisted wire pairs extending in a first direction through the first hole of the first core, around a first side of the first core, through a second hole of the first core, around a second side of the first core, through the first hole of the first core, around the first side of the first core and through the second hole of the first core, and second ends of said first and second twisted wire pairs extending in a second direction through the second hole of the first core, around the first side of the first core, through the first hole of the first core, around the second side of the first core, through the second hole of the first core around the first side of the first core and through the first hole of the first core, said first core and first and second twisted wire pairs forming an isolation magnetic device; and wherein first and second ends of one of said first and second twisted pairs being twisted together and extending through a first hole of the second core, around a first side of the second core, and through the second hole of the second core, around a second side of the second core, through the first hole of the second core, around the first side of the second core and through the second hole of the second core, said second core and said twisted first and second ends of said one of said first and second twisted pairs forming a common mode choke.

10. An isolation magnetic device comprising:

a core including a first hole and a second hole, the second hole of the core being spaced from the first hole and having a longitudinal axis extending parallel to a longitudinal axis of the first hole; and a wire having first and second ends, the first end of the wire extending through the first hole of a core, around a first side of the core and through a second hole of the core in first direction and further extending around a second side of the core, through the first hole of the core, around the first side of the core, through the second hole of the core, around the second side of the core, through the first hole of the core, and around the first side of the core, through the second hole of the core;

the second end of the wire extending through the second hole of the core, around the first side of the core and through the first hole of the core in a second direction and further extending around the second side of the core, through the second hole of the core, around the first side of the core, through the first hole of the core, around the second side of the core, through the second hole of the core, around the first side of the core; and through the first hole of the core and wherein a portion of the wire between the first end and the second end is bunched to produce a tap for said isolation magnetic device;

wherein the wire comprises a first and a second wire; and wherein the core is a first core, and the device further comprises a second core including a first hole and a second hole, the second hole of the second core being spaced from the first hole of the second core and having a longitudinal axis extending parallel to a longitudinal axis of the first hole of the second core;

the first and second ends of the first wire twisted to produce a twisted wire;

the twisted wire extending through the first hole of the second core, around a first side of the second core, and through a second hole of the second core; so that said second core and twisted wire pair constitute a common mode choke.

* * * * *